US006368065B1

(12) United States Patent
Hugenroth et al.

(10) Patent No.: US 6,368,065 B1
(45) Date of Patent: Apr. 9, 2002

(54) LINEAR DRIVE SCROLL COMPRESSOR ASSEMBLE

(75) Inventors: Jason Hugenroth, Hope; Gregory V. Hahn, Arkadelphia; Zili Sun, Arkadelphia; Carlos Zamudio, Arkadelphia; Thomas R. Barito, Arkadelphia, all of AR (US); James W. Bush, Skaneateles, NY (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/693,048

(22) Filed: Oct. 20, 2000

(51) Int. Cl.[7] ..... F04B 17/00

(52) U.S. Cl. ..... 417/53; 418/55.1; 418/55.3; 418/54; 417/213; 417/410.5; 417/310

(58) Field of Search ..... 417/410.5, 310, 417/213, 53; 418/6, 54, 55.1, 55.3

(56) References Cited

U.S. PATENT DOCUMENTS

RE34,413 E * 10/1993 McCullough ..... 418/55.3
5,281,114 A * 1/1994 Bush ..... 418/1
5,531,577 A * 7/1996 Hayase et al. ..... 418/55.1
6,062,833 A * 5/2000 Holzapfel et al. ..... 418/55.3

FOREIGN PATENT DOCUMENTS

DE 1653815 * 8/1971
JP 0410061578 A * 8/1996
JP 0410299675 A * 11/1998
JP 2001123968 A * 5/2001

* cited by examiner

*Primary Examiner*—Charles G. Freay
*Assistant Examiner*—Han L. Liu
(74) *Attorney, Agent, or Firm*—Carlson, Gaskey & Olds

(57) ABSTRACT

A scroll compressor assembly includes a first linear drive for driving a first scroll along a first linear axis and a second linear drive for driving the first or second scroll along a second linear axis which is non-parallel to the first linear axis. Relative orbital movement between the first and second scrolls is obtained by controlling the frequency of oscillations of the first linear motor along a first linear axis and the second linear motor along the second linear axis.

Further, capacity control is achieved by varying the movement of the first and second linear motors.

17 Claims, 3 Drawing Sheets

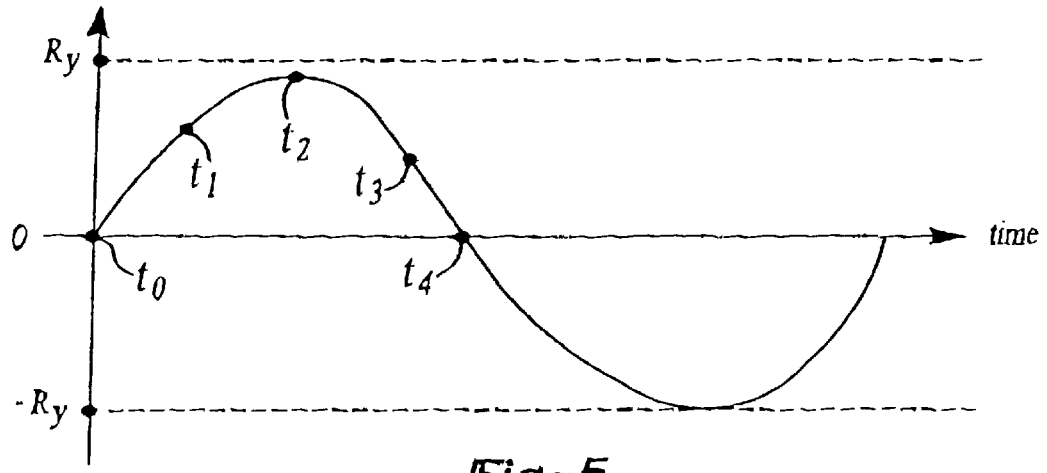
Fig-5
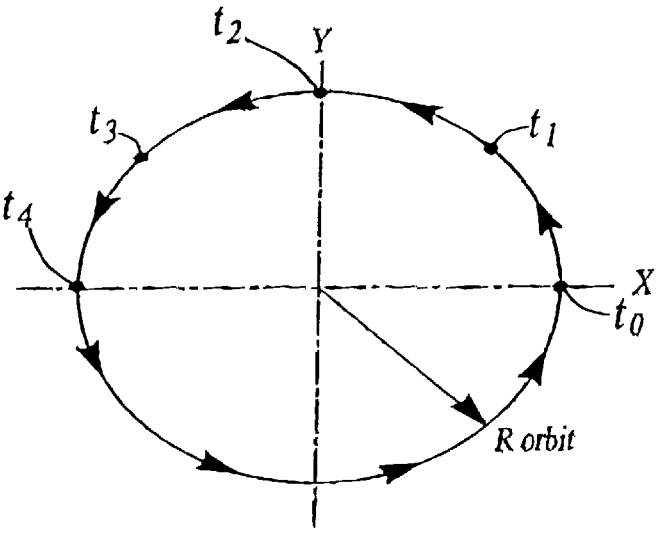
Fig-6
Fig-7
| | Position of orbiting scroll | | | |
|---|---|---|---|---|
| time | X | Y | R | θ (Angular position) |
| $t_0$ | $R_x$ | 0 | R orbit | 0° |
| $t_1$ | $\frac{R_x}{\sqrt{2}}$ | $\frac{Ry}{\sqrt{2}}$ | R orbit | 45° |
| $t_2$ | 0 | Ry | R orbit | 90° |
| $t_3$ | $\frac{-R_x}{\sqrt{2}}$ | $\frac{Ry}{\sqrt{2}}$ | R orbit | 135° |
| $t_4$ | $-R_x$ | 0 | R orbit | 180° |

LINEAR DRIVE SCROLL COMPRESSOR ASSEMBLE

BACKGROUND OF THE INVENTION

This invention relates to a scroll compressor utilizing linear motors to provide orbital movement of the orbiting scroll.

Scroll compressors are becoming widely utilized in refrigerant compression applications. Typically, a scroll compressor assembly includes a housing supporting a non-orbiting scroll. The non-orbiting scroll comprises a generally spiral wrap extending from a base. An orbiting scroll comprising a generally spiral wrap extending from a base is also supported by the housing. The generally spiral wraps of the scrolls intermesh to define a plurality of compression chambers. An electric motor drives the orbiting scroll in an orbit relative to the non-orbiting scroll and as the wraps orbit relative to each other, a refrigerant to be compressed is entrapped and moved toward a discharge port. The refrigerant is then discharged into a discharge pressure chamber.

Typically, the electric motor to drive the orbiting scroll extends linearly along a common axis. This configuration results in an extended overall scroll compressor axial length due to the axial length of a typical electric motor. A smaller scroll compressor would broaden the range of possible applications. For these reasons, it is desirable to design a scroll compressor with a reduced axial length.

A known scroll compressor configuration that reduces the overall axial length of a scroll compressor includes mounting of the electric motor radially outwardly of the interfitting scrolls. A scroll compressor of this configuration comprises an electric motor that is ring-shaped and mounted around the scrolls. The result is a scroll compressor assembly having a compact, relatively short axial length compared to a traditionally configured scroll compressor. However, a scroll compressor with such a co-axial configuration requires a custom manufactured electric motor instead of a low cost commercially available electric motor. Further, the integration of an electric motor and interfitting scrolls complicates assembly that in turn increases the overall cost of the scroll compressor.

For the above reasons it is desirable to provide a scroll compressor having a reduced or compact axial length that may be produced at a low cost.

SUMMARY OF THE INVENTION AND ADVANTAGES

A disclosed scroll compressor assembly includes a first linear drive for driving at least one scrolls along a first linear axis and a second linear drive for driving at least one scroll in a second linear axis. Preferably the second axis is transverse to the first linear axis. The linear drive moves a first and second scroll in an orbit relative to each other.

The subject invention also provides a method of operating a scroll compressor assembly having a first scroll interfit with a second scroll, and a first and second linear drive, attached to drive at least one of the scrolls. The method is comprised of the steps of oscillating at a predetermined frequency one of the first and second scrolls with the first linear drive along a first linear axis and oscillating at a predetermined frequency one of the first and second scrolls with the second linear drive along a second linear axis. The method further includes the step of controlling the frequency of oscillation of the first linear drive relative to the frequency of oscillation of the second linear drive to provide relative orbital movement between the first and second scrolls.

The two linear drives are inexpensive and fit within a small axial envelope. Accordingly, an axially compact scroll compressor is provided by the subject invention, allowing more space for specific applications and the broadening of potential applications. Further, the subject invention utilizes low cost commercially available linear drives simplifying assembly.

Further, with the present invention, capacity modulation can be easily achieved by controlling the drive motors. Capacity modulation is essentially changing the volume of refrigerant which is compressed. Three ways are disclosed to achieve such capacity modulation. First, the frequency of the X and Y drives can be varied together to achieved a change in the speed of the orbiting scroll, and hence the capacity. Secondly, the frequency of the X and Y drives can be varied out of synchronization with each other. This will result in wrap separation for a portion, or all of the orbit, and thus reduce capacity. Finally, the displacements of the X and Y drives can be varied to result in wrap separation, and thus a reduction in capacity. Other ways of changing the capacity can also be utilized.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a graph illustrating movement along the Y-axis;

FIG. 6 is a graph illustrating relative orbiting movement between the scrolls; and FIG. 7 is a table defining the relative angular positions between the scrolls during orbital movement.

DETAILED DESCRIPTION OF THE PREFERRED EMBODIMENT

Figure 1:
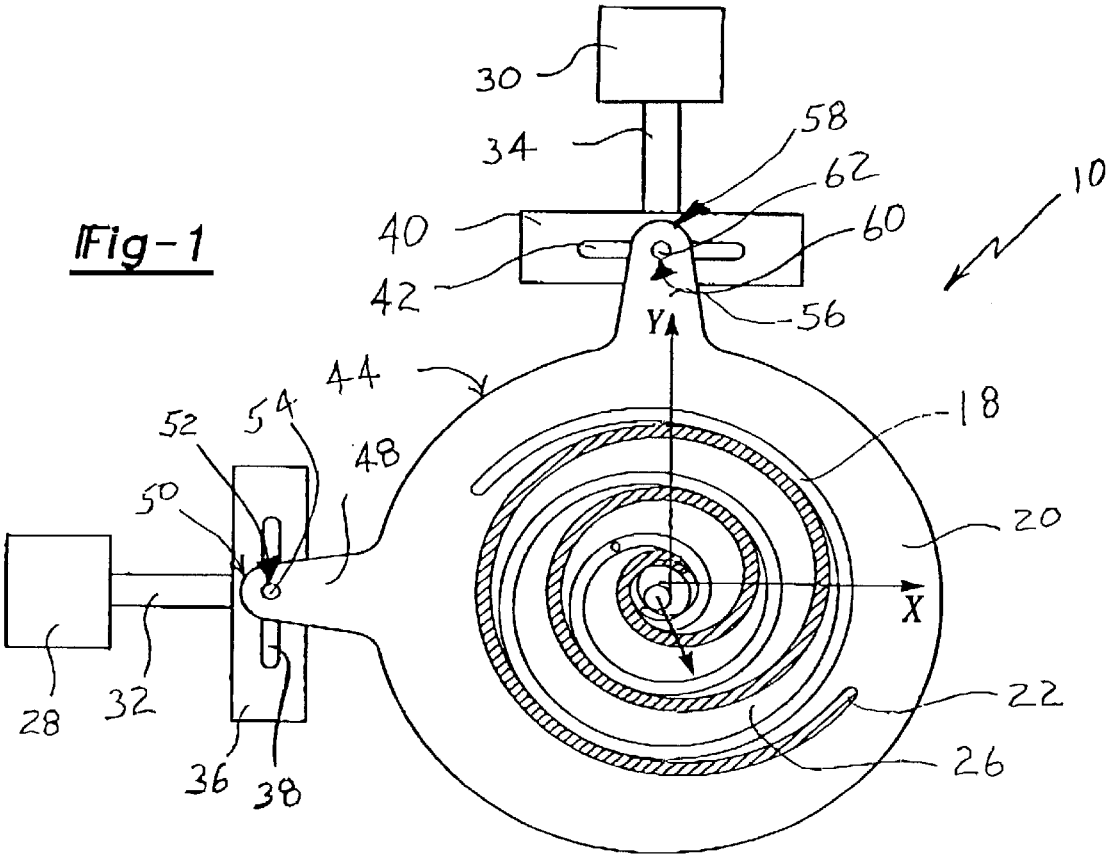
FIG. 1 is a top schematic view of the subject scroll compressor.
Figure 2:
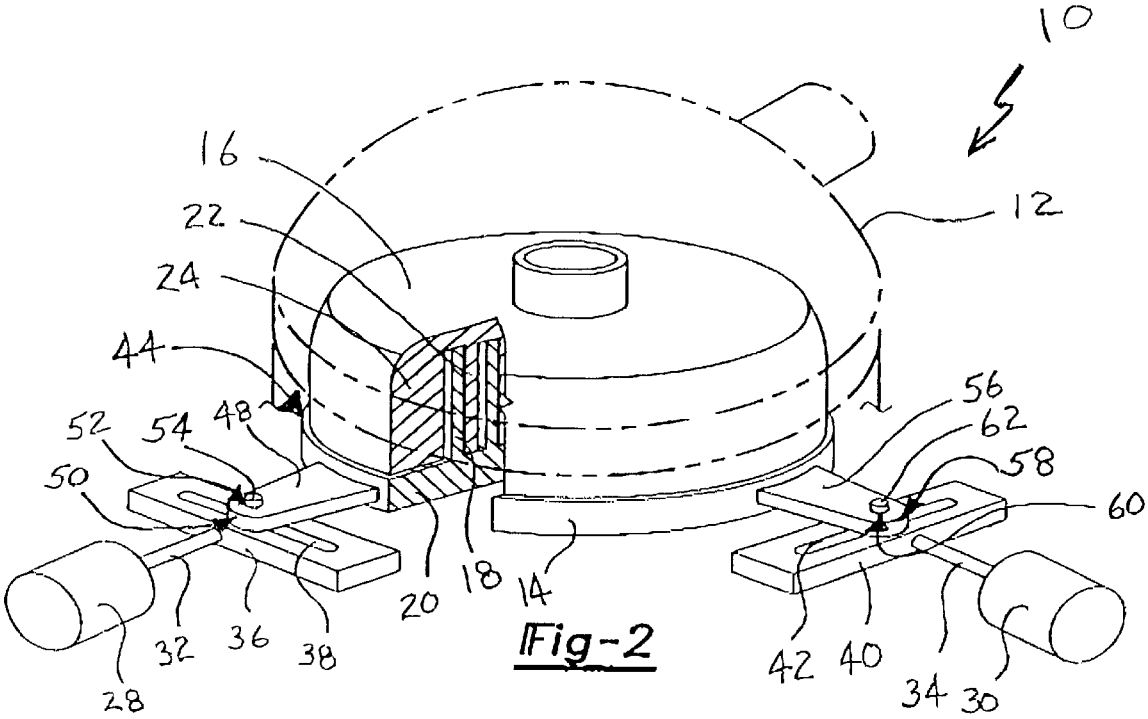
FIG. 2 is a perspective sectional view of one embodiment of the subject scroll compressor.

Referring to the Figures, wherein like numerals indicate like or corresponding parts throughout the several views, a scroll compressor assembly 10 is generally shown at 10. Referring to FIGS. 1 and 2, the scroll compressor assembly 10 comprises a housing 12 supporting a first scroll 14 and a second scroll 16. The first scroll 14 includes a generally spiral wrap 18 extending from a base 20. The second scroll 16 also includes a generally spiral wrap 22 extending from a base 24. The generally spiral wraps 18, 22 interfit to define a plurality of compression chambers 26.

The scroll compressor assembly 10 includes a first linear drive 28 for driving at least one of the first and second scrolls 14,16 along a first linear axis X and a second linear drive 30 for driving at least one of the first and second scrolls 14,16 in a second linear axis Y. The axes X and Y must not be parallel, and are preferably transverse to each other. The linear drives 28,30 my be of any type known in the art. The first and second linear drives 28,30 include a shaft 32,34 having a yoke 36,40 with a cross-slot 38, 42. The yokes 36,40 are disposed at a distal end 50,58 of the shafts 32,34. Actuation of the linear drives 28,30 causes the first and second scrolls 14,16 to orbit relative to each other.

Referring to FIG. 2, a first embodiment of the subject scroll compressor assembly 10 includes attachment of the first and second linear drives 28,30 to the first scroll 14. The first scroll 14 has a perimeter 44 with a first arm 48 extending therefrom. A first point 52 is disposed at a distal end 50 of the first arm 48. The first point 52 defines the placement of a first pin 54. The cross-slot 38 of the yoke 36 guides the first pin 54.

The purpose of the yoke and pin connection is to allow the first linear drive to actuate the first scroll 14 in the first linear axis X while allowing movement in a second linear axis Y. As appreciated, without the use of such a pin and yoke connection, the first scroll 14 would be constrained to movement along the first linear axis X. It is within the contemplation of this invention that any type of connection known in the art that provides for actuation along a first axis X, while functioning to allow movement along a second linear axis Y.

A second arm 56 extends from the perimeter 44 of the first scroll 14 and is located transversely to the first arm 48. A second point 60 and a second pin 62 are disposed at a distal end 58 of the second arm 56. The relative position of the first point 52 to the second point 60 defines a coordinate axis having a first linear axis X, and a second linear axis Y. The second pin 62 is disposed within the yoke cross-slot 42 of the second linear drive 30. The yoke and pin connections between the first scroll 14 and the first and second linear drives 28,30 allow for the simultaneous actuation in the first linear axis X and second linear axis Y.

Figure 3:
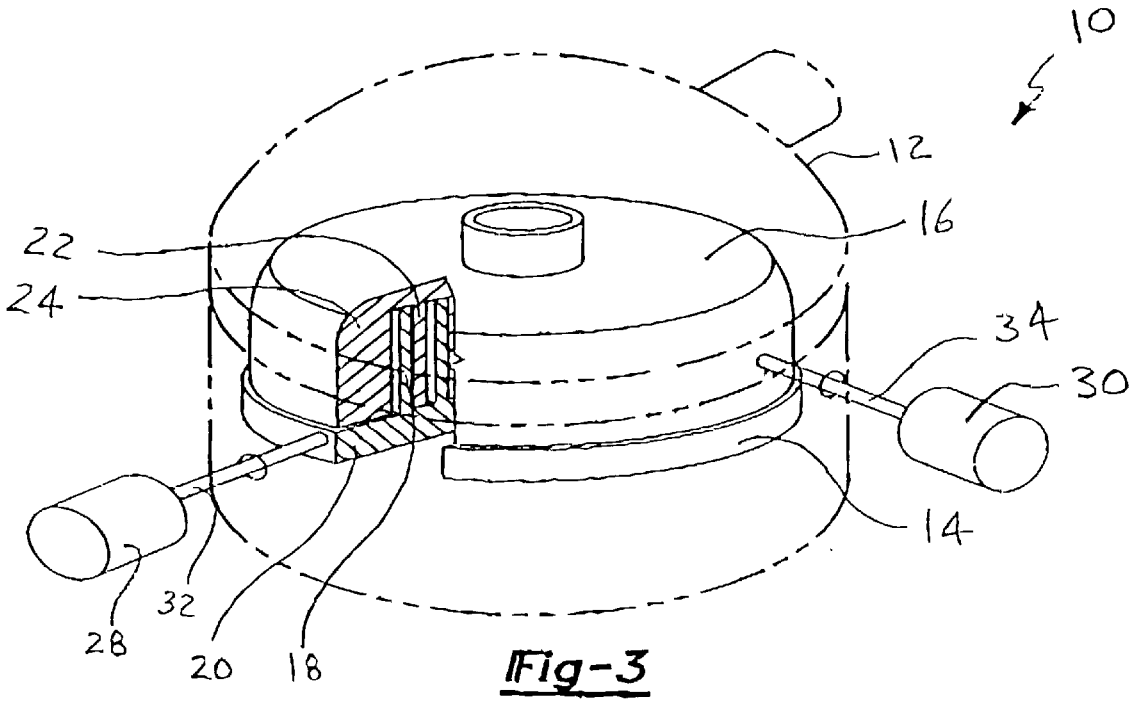
FIG. 3 is a perspective sectional view of another embodiment of the subject scroll compressor.

Referring to FIG. 3, a second embodiment of the subject invention attaches the first linear drive 28 to the first scroll 14 for movement along the first linear axis X. The second linear drive 30 is attached to the second scroll 16 for movement along the second linear axis Y. Unlike the first embodiment, because each scroll moves along a separate axis, a pin and yoke configuration may not be necessary. The first linear drive 28 is rigidly attached to the first scroll 14 and drives the first scroll 14 along the first linear axis X. The second linear drive 30 is rigidly attached to the second scroll 16 and drives the second scroll 16 along the second linear axis Y. Control of the movement of the first scroll 14 relative to movement of the second scroll 16 creates the relative orbit between the scrolls. The relative orbital movement entraps a refrigerant and compresses the refrigerant as the scrolls orbit, causing the compression chambers 26 to travel toward a discharge port (not shown) near a central point of the interfit spiral wraps 18,22.

While motors are shown mounted outside the circumference of the scrolls, they could be moved to a point rearward of the base of the scroll, but within the circumference of the scroll. It should also be understood that the motors 28, 30 are appropriately mounted in the housing.

The subject invention also includes a method of operating a scroll compressor assembly 10 having a first scroll 14 interfit with a second scroll 16, and first and second linear drives 28,30, attached to drive at least one of the scrolls 14,16. The method comprises the steps of oscillating at a predetermined frequency one of the first and second scrolls 14,16 with the first linear drive 28 along a first linear axis X and oscillating at a predetermined frequency one of the first and second scrolls 14,16 with the second linear drive 30 along a second linear axis Y transverse to the first linear axis X. In one embodiment of the subject method, the first linear drive 28 oscillates the first scroll 14, and the second linear drive 30 oscillates the second scroll 16. In a second embodiment of the subject method, the first and second linear drives 28,30 oscillate the first scroll 14.

Figure 4:
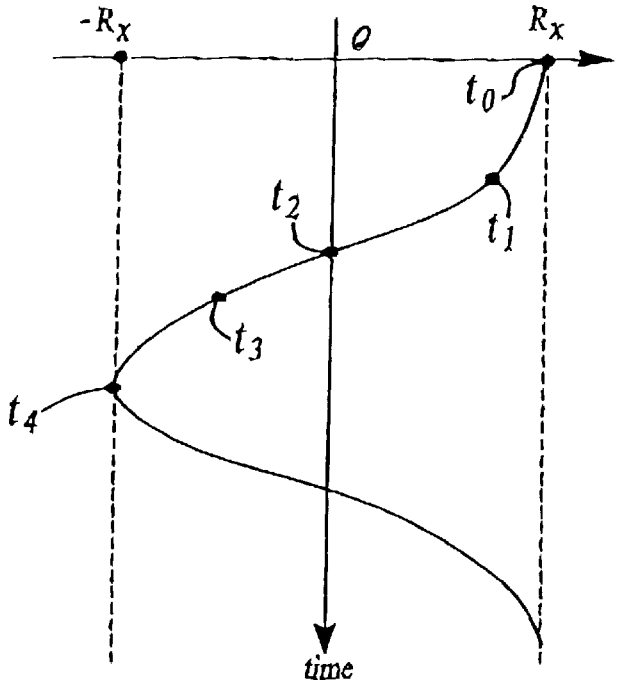
FIG. 4 is a graph illustrating movement along the X-axis.

The oscillating movement along the first linear axis X of the first linear drive 28 is graphically illustrated in FIG. 4. The graph of FIG. 4 shows the position of the first linear drive at a time t. The first linear drive 28 is oscillated at a predetermined frequency along the first linear axis X a distance Rx from the point of origin. The distance Rx is selected with respect to the specific configuration of a particular scroll and the oscillation along the second linear axis. FIG. 5 graphically illustrates corresponding oscillation along the second linear axis Y for a time t. Oscillating movement along the first linear axis X at a predetermined frequency is coordinated relative to a predetermined frequency of movement along the second linear axis Y.

Referring to FIGS. 6 and 7, the method further includes the step of controlling the predetermined frequency of oscillation of the first linear drive 28 relative to the predetermined frequency of oscillation of the second linear drive 30 to provide relative orbital movement between the first and second scrolls 14,16. FIG. 6 illustrates the resultant relative orbital motion between the first and second scrolls 14,16 derived from the oscillation of the first and second scrolls 14,16. FIG. 7 is a table that specifically illustrates the relative angular position between the scrolls for each position of the first and second linear drives 28,30. The relative angular relationship between the first and second scrolls 14,16, tabulated in FIG. 7, apply to both embodiments described hereinabove. In other words, the relative angular relationship tabulated in FIG. 7 applies to driving only the first scroll 14 with both the first and second linear drives 28, 30, and to driving the first scroll 14 along the first axis X with the first linear drive 28, and driving the second scroll 16 along the second axis Y with the second linear drive 30.

A worker in this art would be able to recognize the appropriate movements along the X and Y axis to achieve the relative desired position of the two scroll members. Further, it should be appreciated that while the most simplistic mathematics required to determine the relative movement would be if the axes were perpendicular, as long as the axes are non-parallel, then the orbiting movement would be achievable.

Further, with the present invention, capacity modulation can be easily achieved by controlling the drive motors. Capacity modulation is essentially changing the volume of refrigerant which is compressed. Three ways are disclosed to achieve such capacity modulation. First, the frequency of the X and Y drives can be varied together to achieved a change in the speed of the orbiting scroll, and hence the capacity. Secondly, the frequency of the X and Y drives can be varied out of synchronization with each other. This will result in wrap separation for a portion, or all of the orbit, and thus reduce capacity. Finally, the displacements of the X and Y drives can be varied to result in wrap separation, and thus a reduction in capacity. Other ways of changing the capacity can also be utilized.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that within the scope of the description, wherein reference numerals are merely for convenience and are not to be in any way limiting, the invention may be practiced otherwise than as specifically described.

What is claimed is:

1. A scroll compressor assembly comprising:

a first scroll having a base with a generally spiral wrap extending from said base;

a second scroll having a base with a generally spiral wrap extending from said base;

said generally spiral wraps of said first and second scrolls interfitting to define a plurality of compression chambers;

said scroll compressor assembly including a first linear drive for driving at least one of said first and second scrolls along a first linear axis and a second linear drive for driving at least one of said first and second scrolls along a second linear axis which is non-parallel to said first linear axis, whereby actuation of said linear drives moves said first scroll in an orbit relative to said second scroll.

2. A scroll compressor as set forth in claim 1, wherein both of said first and second linear drives are attached to said first scroll.

3. A scroll compressor assembly as set forth in claim 2, wherein said first scroll includes a first pin disposed at a first point and a second pin disposed at a second point, and said first and second linear drives include a shaft having a yoke with a cross slot at a distal end of said shaft, and said first pin is disposed within said yoke cross-slot of said first linear drive and said second pin is disposed within said yoke cross-slot of said second linear drive.

4. A scroll compressor assembly as set forth in claim 3, wherein said first scroll includes a perimeter with a first arm extending from said perimeter, said first point and first pin are disposed at a distal end of said first arm, and a second arm extending from said perimeter and located transversely to said first arm, said second point and said second pin are disposed at a distal end of said second arm.

5. A scroll compressor assembly as set forth in claim 1, wherein said first linear drive is attached to said first scroll for movement along said first linear axis and the second linear drive is attached to said second scroll for movement along said second linear axis, said axes being perpendicular to each other.

6. A scroll compressor assembly as set forth in claim 5, wherein said first linear drive is rigidly attached to said first scroll for movement along said first linear axis, and said second linear drive is rigidly attached to said second scroll for movement along said second linear axis.

7. A scroll compressor assembly as set forth in claim 1, wherein said first and second linear drives can be controlled to vary the capacity of said compressor.

8. A scroll compressor assembly as set forth in claim 7, wherein said linear drives have a frequency which is varied to achieve a change in orbital speed of said orbiting scroll and hence change compressor capacity.

9. A scroll compressor assembly as set forth in claim 7, wherein a frequency of said first and second linear drives is varied to be out of synchronization to result in wrap separation, and thus a reduction in capacity.

10. A scroll compressor assembly as set forth in claim 7, wherein a displacement amount of said first and second linear drives is varied to result in wrap separation, and thus capacity modulation.

11. A method of operating a scroll compressor assembly having a first scroll interfit with a second scroll, and a first and second linear drive, attached to drive at least one of the scrolls, said method comprising the steps of:

oscillating at a predetermined frequency one of the first and second scrolls with the first linear drive along a first linear axis;

oscillating at a predetermined frequency one of the first and second scrolls with the second linear drive along a second linear axis non-parallel to the first linear axis;

controlling the frequency of oscillation of the first linear drive relative to the frequency of oscillation of the second linear drive to provide relative orbital movement between the first and second scrolls.

12. The method as set forth in claim 11, wherein the first linear drive oscillates the first scroll, and the second linear drive oscillates the second scroll.

13. The method as set forth in claim 11, wherein the first linear drive oscillates the first scroll along the first linear axis, and the second linear drives oscillates the first scroll along the second linear axis.

14. The method as set forth in claim 11, wherein the movement of said first and second scrolls is controlled to achieve capacity modulation.

15. The method as set forth in claim 14, wherein the frequency of said first and second linear drives is varied together to achieve a change in orbital speed, and thus capacity control.

16. The method as set forth in claim 14, wherein the frequency of said first and second linear drives is varied to be non-synchronous to result in wrap separation, and thus capacity control.

17. The method as set forth in claim 14, wherein a displacement of said first and second linear drives is varied to result in wrap separation and thus capacity control.

* * * * *